United States Patent [19]

Inaba et al.

[11] Patent Number: 4,613,878

[45] Date of Patent: Sep. 23, 1986

[54] TWO-COLOR THERMOSENSITIVE RECORDING MATERIAL

[75] Inventors: Norihiko Inaba, Numazu; Kiyotaka Iiyama, Mishima, both of Japan

[73] Assignee: Ricoh Company, Ltd., Tokyo, Japan

[21] Appl. No.: 798,420

[22] Filed: Nov. 15, 1985

[30] Foreign Application Priority Data

Nov. 15, 1984 [JP] Japan ..... 59-241333
Dec. 27, 1984 [JP] Japan ..... 59-273816

[51] Int. Cl.[4] ..... B41M 5/18

[52] U.S. Cl. ..... 346/204; 346/205; 346/226; 427/151; 427/152

[58] Field of Search ..... 346/204, 205, 206, 220, 346/221, 226; 427/150, 151, 152

[56] References Cited

FOREIGN PATENT DOCUMENTS 0025306 2/1980 Japan ..... 346/204
0025987 2/1983 Japan ..... 346/205

*Primary Examiner*—Bruce H. Hess

*Attorney, Agent, or Firm*—Oblon, Fisher, Spivak, McClelland & Maier

[57] ABSTRACT

A two-color thermosensitive recording material comprising a support material, a first lower thermosensitive coloring layer and a second upper thermosensitive coloring layer supported on the support material, capable of yielding two different colors, with the coloring temperature for the second thermosensitive coloring layer being lower than that for the first thermosensitive coloring layer, in which at least the second thermosensitive coloring layer contains a basic leuco dye and a color developer capable of inducing color formation in the leuco dye upon application of thermal energy, and a decolorizing agent for decoloring the color developed in the second thermosensitive coloring layer at the time of color development of the first thermosensitive coloring layer is contained in the first thermosensitive coloring layer or in a decolorizing intermediate layer interposed between the first thermosensitive coloring layer and the second thermosensitive layers, which decolorizing agent is a di-substituted aromatic diamide derivative or a piperazine derivative including two acylamino groups.

7 Claims, No Drawings

TWO-COLOR THERMOSENSITIVE RECORDING MATERIAL

BACKGROUND OF THE INVENTION

The present invention relates to a two-color thermosensitive recording material and more particularly to a two-color thermosensitive recording material comprising a support material and two thermosensitive coloring layers successively formed thereon, each coloring layer being capable of yielding a different color by application of a different quantity of thermal energy thereto.

A conventional thermosensitive recording material comprises a support material such as a sheet of paper and a thermosensitive coloring layer formed on the support material, on which thermosensitive coloring layer colored images can be formed by application of heat thereto. For heat application for image formation, a thermal head is in general use. In such a conventional thermosensitive recording material, there are usually employed in the thermosensitive coloring layer a colorless or light-colored leuco dye containing a lactone ring, a lactam ring or a spiropyran ring, and a color developer which induces color formation in the leuco dye upon application of heat by the reaction with the leuco dye, since it is capable of yielding clear images with minimized fogging.

Because of the capability of forming colored images by simple application of heat, such thermosensitive recording materials are widely used, not only for copying books and documents, but also for recording output information from computers, facsimile apparatus, telex and other information transmission and measuring instruments. Depending upon the recording mode, it will be more convenient if it is allowed to record particular data in a different color from the remainder on a thermosensitive recording material in order to display the particular data more distinctly from the remainder.

Recently, many trials have been made to attain recording with multiple colors by applying heat at different temperatures or by applying different quantities of thermal energy. Accordingly, a variety of multi-color thermosensitive recording sheets have been proposed.

A conventional multi-color thermosensitive recording sheet comprises a support material and two thermosensitive color-forming layers overlaying the support material, which color-forming layers are colored in different colors upon application of different thermal energies thereto respectively. One layer is referred to as, for example, a high-temperature color-forming layer and the other is referred to as, for example, a low-temperature color-forming layer. The low-temperature color-forming layer forms a color at a low temperature, while the high-temperature color-forming layer does not form a color at all at the low temperature, but forms a color at a high temperature which is higher than the low temperature, and the two colors are different from each other.

Such conventional multi-color thermosensitive recording sheets can be roughly classified into the following two types.

In one type, when a high-temperature color-forming layer is colored by application of heat at a high temperature, the color developed in the high-temperature color-forming layer is mixed with the color already developed in a low-temperature color-forming layer, so that a different color from the color in the low-temperature layer is produced in the high-temperature color-forming layer.

In the other type, when the high-temperature color-forming layer is colored, the color in the low-temperature color-forming layer is decolorized by a decolorizing agent, so that only the high-temperature color-forming layer is colored without the color of the low-temperature color-forming layer being mixed therewith.

Specific examples of the former type are disclosed, for instance, in Japanese Patent Publications No. 49-69, No. 49-4342 and No. 49-27708, and Japanese Laid-Open Patent Applications No. 48-86543 and No. 49-65239.

Specific examples of the latter type are disclosed, for instance, in Japanese Patent Publications No. 50-17865, No. 50-17866, No. 51-29024 and No. 51-87542, and Japanese Laid-Open Patent Applications No. 50-18048 and No. 53-47843.

The former type has the shortcoming that the practically developable color systems are limited to such combinations that the color developed at high temperature can overcome the color developed at low temperature, such as red (low temperature)—black (high temperature), and blue (low temperature)—black (high temperature).

In the latter type, there are no particular limitations to the combination of colors. However, a decolorizing agent capable of completely decolorizing the color developed in the low-temperature coloring color-forming layer (when developing a color in the high temperature color-forming layer) has not been discovered, although higher aliphatic alcohols, polyether, polyethylene glycol derivatives, nitrogen-containing compounds such as acetamide, stearamide, phthalonitrile, and amine derivatives such as guanidine derivatives are proposed as such decolorizing agents, so that the separation of the color in the high temperature color-forming layer from the color in the low temperature color-forming layer is incomplete. The result is that the color developed in the low temperature color-forming layer spreads and overlaps the color developed in the high temperature color-forming layer. In order to avoid such problem, it is necessary to overlay a high temperature color-forming layer, a decolorizing layer and a low temperature color-forming layer successively on a support material and to increase the thickness of the decolorizing layer so as to completely decolorize the color developed in the low temperature color-forming layer. However, when such a thick decolorizing layer is formed in the above thermosensitive recording sheet, a large quantity of thermal energy is required for color development in the high temperature color-forming layer by a printer or facsimile apparatus including a thermal head, and the color in the high temperature color-forming layer (located lowermost) cannot always be developed to its full extent in the high speed recording when a high speed recorder is employed, since quick heat transfer in the direction of the depth of the thermosensitive coloring layer is hindered by the depth of the layer.

SUMMARY OF THE INVENTION

It is therefore an object of the present invention to provide a two-color thermosensitive recording material using leuco dyes capable of yielding clear color images with excellent color separation, having high densities, which do not discolor with time.

According to the present invention, the above object of the present invention is achieved by a two-color thermosensitive recording material comprising a support material, a first thermosensitive coloring layer and a second thermosensitive coloring layer supported on the support material, with the second thermosensitive coloring layer overlaid on the first thermosensitive coloring layer, the colors developed by the two coloring layers being different from each other, the coloring temperature for the second thermosensitive coloring layer being lower than that for the first thermosensitive coloring layer, in which at least the second thermosensitive coloring layer contains a basic leuco dye and a color developer capable of inducing color formation in the leuco dye upon application of thermal energy, and a decolorizing agent for decoloring the color developed in the second thermosensitive coloring layer at the time of color development of the first thermosensitive coloring layer is contained in the first thermosensitive coloring layer or in a decolorizing intermediate layer that can be interposed between the first and second thermosensitive layers, which decolorizing agent is selected from the group consisting of (i) a di-substituted aromatic diamide derivative and (ii) a piperazine derivative having two acylamino groups.

DETAILED DESCRIPTION OF THE PREFERRED EMBODIMENTS

The di-substituted aromatic diamide derivative for use in the present invention, which serves as the decoloring agent for decoloring the color developed in the second thermosensitive coloring layer at the time of color development of the first thermosensitive coloring layer, has the following formula (I):

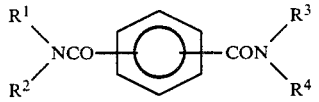

(I)

wherein $R^1$, $R^2$, $R^3$ and $R^4$ independently represent hydrogen, an alkyl group, a cycloalkyl group, an aryl group or an aralkyl group, and $R^1$ and $R^2$, and/or $R^3$ and $R^4$ can respectively form rings by the terminals of the respective groups being combined with each other.

Examples of the above alkyl group are straight chain alkyl groups having 1 to 18 carbon atoms and branched alkyl groups having 3 to 18 carbon atoms; an example of the cycloalkyl group is cyclohexyl group; examples of the aryl group are phenyl group, tolyl group and xylyl group; and examples of the aralkyl group are benzyl group and phenethyl group.

The above groups can further have substituents, for example, alkyl group, aryl group, halogen and acylamino group such as benzoylamino and acetylamino groups.

Specific examples of the above di-substituted aromatic diamide derivative are as follows:

N,N'-terephthaloylbispiperizine,
N,N'-isophthaloylbispiperizine,
N,N'-phthaloylbispiperizine,
N,N'-terephthaloylbismorpholine,
N,N'-isophthaloylbismorpholine,
N,N'-phthaloylbismorpholine,
N,N'-terephthaloylbis-4-methylpiperazine,
N,N'-isophthaloylbis-4-methylpiperazine,
N,N'-phthaloylbis-4-methylpiperazine,
N,N'-terephthaloylbis-4-phenylpiperazine,
N,N'-isophthaloylbis-4-phenylpiperazine,
N,N'-phthaloylbis-4-phenylpiperazine,
N,N'-terephthaloylbis-4-propylpiperazine,
N,N'-isophthaloylbis-4-propylpiperazine,
N,N'-phthaloylbis-4-propylpiperazine,
N,N'-terephthaloylbiscaprolactam,
N,N'-isophthaloylbiscaprolactam,
N,N'-phthaloylbiscaprolactam,
N,N'-terephthaloylbis-3-chlorocaprolactam,
N,N'-isophthaloylbis-3-chlorocaprolactam,
N,N'-phthaloylbis-3-chlorocaprolactam,
N,N'-terephthaloylbisvalerolactam,
N,N'-isophthaloylbisvalerolactam,
N,N'-phthaloylbisvalerolactam,
N,N'-terephthaloylbispyrrolidine,
N,N'-isophthaloylbispyrrolidine,
N,N'-phthaloylbispyrrolidine,
N,N'-terephthaloylbis-diethylamine,
N,N'-isophthaloylbis-diethylamine,
N,N'-phthaloylbis-diethylamine,
N,N'-terephthaloylbis-dipropylamine,
N,N'-isophthaloylbis-dipropylamine,
N,N'-terephthaloylbis-dibutylamine,
N,N'-isophthaloylbis-dibutylamine,
N,N'-terephthaloylbis-cyclohexyl-methylamine,
N,N'-isophthaloylbis-cyclohexyl-methylamine,
N,N'-terephthaloylbis-dicyclohexylamine,
N,N'-isophthaloylbis-dicyclohexyamine,
N,N'-terephthaloylbis-dibenzylamine,
N,N'-isophthaloylbis-dibenzylamine,
N,N'-terephthaloylbis-dioctylamine,
N,N'-isophthaloylbis-dioctylamine,
N,N'-terephthaloylbis-diethoxypropylamine,
N,N'-terephthaloylbis-4-chlorobutylamine,
N,N'-terephthaloylbis-dibenzoylaminoethylamine,
N,N'-isophthaloylbis-dibenzoylaminoethylamine,
N,N'-terephthaloylbis-benzoylaminopropylamine,
N,N'-isophthaloylbis-benzoylaminopropylamine,
N,N'-terephthaloylbis-diacetylaminoethylamine, and
N,N'-isophthaloylbis-diacetylaminoethylamine.

The piperazine derivative for use in the present invention, which serves as the decoloring agent for decoloring the color developed in the second thermosensitive coloring layer at the time of color development of the first thermosensitive coloring layer, has the following formula (II):

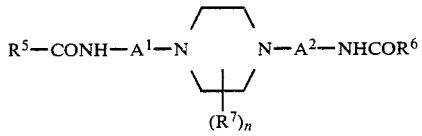

(II)

wherein $A^1$ and $A^2$ represent an alkylene group, $R^5$ and $R^6$ independently represent hydrogen, a non-substituted or substituted alkyl group, a non-substituted or substituted aryl group, a non-substituted or substituted aralkyl group, a non-substituted or substituted cycloalkyl group, $R^7$ represents a lower alkyl group, and n is an integer of 0 to 2.

In $A^1$ and $A^2$, examples of the above alkylene group are straight chain alkylene groups having 1 to 18 carbon atoms and branched alkylene groups having 3 to 18 carbon atoms.

In $R^5$ and $R^6$, examples of the alkyl group are straight chain alkyl groups having 1 to 18 carbon atoms and branched alkyl groups having 3 to 18 carbon atoms; examples of the aryl group are phenyl group, tolyl group and xylyl group; examples of the aralkyl group are benzyl group and phenethyl group; and an example of the cycloalkyl group is cyclohexyl group.

In $R^7$, examples of the lower alkyl group are alkyl groups having 1 to 6 carbon atoms, such as methyl group, ethyl group, propyl group, butyl group and hexyl group.

The above groups can further have substituents, for example, alkyl group, aryl group, halogen, alkoxy group, aryloxy group, alkoxycarbonyl group, aryloxycarbonyl group, and acylamino group such as benzoylamino and acetylamino groups.

Specific examples of the above piperazine derivative are as follows:

N,N'-bis(benzoylaminopropyl)piperazine,
N,N'-bis(benzoylaminoethyl)piperazine,
N,N'-bis(benzoylaminobutyl)piperazine,
N,N'-bis(benzoylaminopentyl)piperazine,
N,N'-bis(benzoylaminohexyl)piperazine,
N,N'-bis(benzoylaminooctyl)piperazine,
N,N'-bis(benzoylaminolauryl)piperazine,
N,N'-bis(benzoylaminostearyl)piperazine,
N,N'-bis(p-chlorobenzoylaminopropyl)piperazine,
N,N'-bis(p-isopropylbenzylaminopropyl)piperazine,
N,N'-bis(p-methylbenzoylaminopropyl)piperazine,
N,N'-bis(m-methylbenzoylaminopropyl)piperazine,
N,N'-bis(o-chlorobenzoylaminopropyl)piperazine,
N,N'-bis(p-chlorobenzoylaminoethyl)piperazine,
N,N'-bis(p-chlorobenzoylaminohexyl)piperazine,
N,N'-bis(p-methylbenzoylaminohexyl)piperazine,
N,N'-bis(o-chlorobenzoylaminohexyl)piperazine,
N,N'-bis(benzoylaminopropyl)piperazine,
N,N'-bis(cyclohexylaminopropyl)piperazine,
N,N'-bis(cyclohexylbutylylaminopentyl)piperazine,
N,N'-bis(pivaloylaminopropyl)piperazine,
N,N'-bis(stearoylaminopropyl)piperazine,
N,N'-bis(phenylacetylaminopropyl)piperazine,
N,N'-bis(phenethyloylaminostearyl)piperazine,
N,N'-bis(α-naphthoylaminoethyl)piperazine,
N,N'-bis(β-naphthoylaminoethyl)piperazine,
N,N'-bis(α-naphthoylaminopropyl)piperazine,
N,N'-bis(β-naphthoylaminopropyl)piperazine,
N,N'-bis(p-methoxycarbonylbenzoylaminopropyl) piperazine, and
N,N'-bis(p-methoxybenzoylaminopropyl)piperazine.

The above decolorizing agents for use in the present invention are extremely effective for decolorizing the color developed in the second thermosensitive coloring layer comprising a basic leuco dye and a color developer capable of inducing color formation in the leuco dye by application of a relatively low thermal energy. In comparison with the conventional decolorizing agents, higher decolorizing effect can be obtained by use of a smaller amount of the decolorizing agents.

In the present invention, one of the above decolorizing agents is disposed in such a position as to decolorize the color developed in the second thermosensitive coloring layer at the time of color development in the first thermosensitive coloring layer by application of a higher thermal energy. Generally, the decolorizing agent can be contained in an intermediate (decolorizing) layer interposed between the second thermosensitive coloring layer and the first thermosensitive coloring layer or in the first thermosensitive coloring layer.

In an embodiment of a two-color thermosensitive recording material according to the present invention, an acidic leuco dye is contained in the first thermosensitive coloring layer, and as a color developer for inducing color formation in the acidic leuco dye, the above mentioned di-substituted aromatic diamide derivative or the above mentioned piperazine derivative is employed. In such an embodiment, the di-substituted aromatic diamide derivative or the piperazine derivative contained in the first thermosensitive coloring layer works as the color developer for the acidic leuco dye in the first thermosensitive coloring layer and as the decolorizing agent for the second thermosensitive coloring layer.

As the acidic leuco dyes, in which color formation is induced by the above mentioned di-substituted aromatic diamide derivative or by the above mentioned piperazine derivative, for example, the following can be employed:

3,3-bis(p-acetyloxyphenyl)phthalide,
3,3-bis(3,5-dibromo-4-acetyloxyphenyl)phthalide,
3,3-bis(3-methyl-4-acetyloxyphenyl)phthalide,
3,3-bis(3-isopropyl-4-acetyloxyphenyl)phthalide,
3,3-bis(p-acetyloxyphenyl)-4',5',6',7'-tetrachlorophthalide,
3,6-diacetyloxyfluoresceine,
3,6-diacetyloxy-2,4,5,7-tetrabromofluoresceine,
3,6-diacetyloxy-4',5',6',7'-tetrachlorofluoresceine, and
3,6-diacetyloxy-2,4,5,7-tetrabromo-4',5',6',7'-tetrachlorofluoresceine.

As the basic leuco dyes for use in the second thermosensitive coloring layer in the present invention, conventional leuco dyes can be employed. They can be used alone or in combination. Examples of such leuco dyes are triphenylmethane-type leuco compounds, fluoran-type leuco compounds, phenothiazine-type leuco compounds, auramine-type leuco compounds and spiropyran-type leuco compounds.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylaminobenzo[α]fluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran, 3-(2'-hydroxy-4'-dimethylaminophenyl)-3-(2'-methoxy-5'-chlorophenyl)phthalide,
3'-(2'-hydroxy-4'-dimethylaminophenyl)-3-(2'-methoxy-5'-nitrophenyl)phthalide,
3-(2'-hydroxy-4'-dimethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthylamino-4'-bromofluoran, and
3-diethylamino-6-methyl-7-mesidino-4',5'-benzofluoran.

As mentioned previously, these leuco dyes can be used alone or in combination.

When a decolorizing layer containing the previously mentioned di-substituted aromatic diamide derivative or piperazine derivative is interposed between the first thermosensitive coloring layer and the second thermosensitive coloring layer, the following basic leuco dyes are suitable for use in the first thermosensitive coloring layer:

3-diethylamino-7-chlorofluoran,
3-diethylamino-6-methyl-7-chlorofluoran,
3-cychohexylamino-6-chlorofluoran, and
3-diethylaminobezo[α]fluoran.

As the color developers capable of inducing color formation in the above mentioned basic leuco dyes, for example, the following can be employed:

N,N'-diphenylthiourea,
N-p-ethylphenyl-N'-phenylthiourea,
N-p-butylphenyl-N'-phenylthiourea,
N,N'-di(m-chlorophenyl)thiourea,
N,N'-di(p-chlorophenyl)thiourea,
N,N'-di(m-trifluoromethylphenyl)thiourea,
N,N'-di(m-methylphenyl)thiourea,
4,4'-isopropylidenediphenol,
4,4'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2-tert-butylphenol),
4,4'-sec-butylidenediphenol,
4,4'-cychlohexylidenebis(2-methylphenol),
4-tert-butylphenol,
4-phenylphenol,
4-hydroxydiphenoxide,
α-naphthol,
β-naphthol,
3,5-xylenol,
thymol,
methyl 4-hydroxybenzoate,
4-hyroxyacetophenone,
novolak-type phenolic resin,
2,2'-thiobis(4,6-dichlorophenol),
catechol,
resorcinol,
hydroquinone,
pyrogallol,
phloroglucine,
phloroglucinocarboxylic acid,
4-tert-octylcatechol,
2,2'-methylenebis(4-chlorophenol),
2,2'-methlenebis(4-methyl-6-tert-butylphenol),
2,2'-dihydroxy-diphenyl,
ethyl p-hydroxybenzoate,
propyl p-hydroxybenzoate,
butyl p-hydroxybenzoate,
benzyl p-hydroxy-benzoate,
p-chlorobenzyl p-hydroxybenzoate,
o-chlorobenzyl p-hydroxybenzoate,
p-methylbenzyl p-hydroxybenzoate,
n-octyl benzoic acid p-hydroxybenzoate,
zinc salicylate,
1-hydroxy-2-naphthoic acid,
2-hydroxy-6-naphthoic acid,
zinc 2-hydroxy-6-naphthoate,
4-hydroxy diphenyl sulfone,
4-hydroxy-4'-chlorodiphenyl sulfone, and
bis(4-hydroxyphenyl)sulfide.

In addition to the previously mentioned leuco dye coloring systems, the following coloring systems can also be employed in the first thermosensitive coloring layer:

(1) A thermosensitive coloring system comprising a combination of (a) a long-chain fatty acid iron salt such as iron stearate and iron myristate, and (b) a phenolic compound such as gallic acid and ammonium salicylate.

(2) A thermosensitive coloring system comprising a combination of (a) an organic heavy metal salt such as nickel-, cobalt-, lead-, copper-, iron-, mercury- and silver-salts of acetic acid, stearic acid and palmitic acid and (b) an alkali earth metal sulfide, such as calcium sulfide, strontium sulfide and potassium sulfide, or a combination of (a) one of the above organic heavy metal salts and (c) an organic chelating agent such as s-diphenylcarbazide and diphenylcarbazone.

(3) A thermosensitive coloring system comprising a combination of (a) a heavy metal sulfate, such as silver sulfate, lead sulfate, mercury sulfate and thorium sulfate, and (b) a sulfur compound such as sodium tetrathionate, sodium thiosulfate and thiourea.

(4) A thermosensitive coloring system comprising a combination of (a) a fatty acid iron salt such as iron stearate and (b) an aromatic polyhydroxy compound such as 3,4-dihydroxytetraphenylmethane.

(5) A thermosensitive coloring system comprising a combination of (a) an organic acid noble metal salt such as silver oxalate and mercury oxalate and (b) an organic polyhydroxy compound such as polyhydroxy alcohol, glycerol and glycol.

(6) A thermcsensitive coloring system comprising a combination of (a) an organic acid metal salt such as silver behenate and silver stearate and (b) an aromatic organic reducing agent such as protocatechuic acid, spiro-indane and hydroquinone.

(7) A thermosensitive coloring system comprising a combination of (a) a fatty acid iron salt such as iron pelagonate and iron lurate and (b) a thiosemicarbamide derivative or an isothiosemicarbamide derivative.

(8) A thermosensitive coloring system comprising a combination of (a) an organic acid lead salt such as lead caproate, lead pelargonate and lead behenate and (b) a thiourea derivative such as ethylenethiourea and N-dodecylthiourea.

(9) A thermosensitive coloring system comprising a combination of (a) a higher fatty acid heavy metal salt such as iron stearate and copper stearate and (b) lead dialkyl dithocarbamate.

(10) A thermosensitive coloring system capable of forming an oxazine dye, for instance, a coloring system comprising a combination of (a) resorcinol and (b) a nitroso compound, and a thermosensitive coloring system forming an azo dye.

In the present invention, a wide variety of conventional binder agents can be employed for fixing the above-mentioned thermosensitive coloring layers and decolorizing layer to the support material and to the other layers in contact therewith.

Examples of the binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid three-dimensional copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

In the present invention, when necessary, auxiliary additives which are conventionally employed in the thermosensitive recording materials of this type, for example, fillers, surface active agents and thermofusible materials, can be added to the above mentioned leuco dyes and color developers.

Specific examples of the fillers are calcium carbonate, silica, zinc oxide, titanium oxide, aluminum hydroxide, zinc hydroxide, barium sulfate, clay, talc, surface-treated inorganic powder, for example, of calcium and silica, and powder of organic materials, such as urea-formaldehyde resin, styrene/methacrylic acid copolymer and polystyrene.

Specific examples of the thermofusible materials are higher fatty acids, esters, amides and metal salts of higher fatty acids, a variety of waxes, condensates of aromatic carboxylic acids and amines, benzoic acid phenyl esters, higher straight-chain glycols, 3,4-epoxydialkyl hexahydrophthalate, higher ketones, and other thermofusible organic compounds having a melting point in the range of about 50° C. to about 200° C.

In the present invention, an intermediate layer and a protective layer, each containing as the main components one of the above mentioned binder agents and one of the thermofusible materials, can be formed when necessary.

By referring to the following examples, the present invention will now be explained in detail.

EXAMPLE 1-1

(1) Preparation of First Thermosensitive Coloring Layer Formation Liquid

Dispersions A and B were prepared by dispersing the following components of each dispersion in a sand mill until the average particle size of each solid component became 2 to 3 μm.

| Dispersion A | Parts by Weight |
|---|---|
| 3-diethylamino-7-chlorofluoran (Red) | 20 |
| 10% aqueous solution of hydroxyethylcellulose | 20 |
| Water | 60 |

| Dispersion B | Parts by Weight |
|---|---|
| Bisphenol A | 12 |
| Ethylenebisstearamide | 6 |
| Calcium carbonate | 9 |
| 10% aqueous solution of polyvinyl alcohol | 30 |
| Water | 43 |

10 parts by weight of the above prepared Dispersion A, 60 parts by weight of Dispersion B and 30 parts by weight of water were mixed well, so that a first thermosensitive coloring layer formation liquid was prepared.

(2) Preparation of Decolorizing Layer Formation Liquid

Dispersion C-1 was prepared by dispersing the following components in a sand mill until the average particle size of each solid component became 2 to 3 μm:

| Dispersion C-1 | Parts by Weight |
|---|---|
| N,N'—isophthaloylbiscaprolactam | 20 |
| 10% aqueous solution of polyvinyl alcohol | 20 |
| Water | 60 |

(3) Preparation of Second Thermosensitive Coloring Layer Formation Liquid

Dispersions D and E were prepared by dispersing the following components of each dispersion in a sand mill until the average particle size of each solid component became 2 to 3 μm.

| Dispersion D | Parts by Weight |
|---|---|
| 3-(N—ethyl-N—amylamino)-6-methyl-7-anilinofluoran (Black) | 20 |
| 10% aqueous solution of hydroxyethylcellulose | 20 |
| Water | 60 |

| Dispersion E | Parts by Weight |
|---|---|
| 3,3'-dichlorophenylthiourea | 12 |
| Stearamide | 6 |
| Calcium carbonate | 12 |
| 10% aqueous solution of polyvinyl alcohol | 30 |

-continued

| Dispersion E | Parts by Weight |
|---|---|
| Water | 40 |

10 parts by weight of the above prepared Dispersion D, 40 parts by weight of Dispersion E and 50 parts by weight of water were mixed well, so that a second thermosensitive coloring layer formation liquid was prepared.

The first thermosensitive coloring layer formation liquid was first coated on a sheet of commercially available high quality paper (with a basis weight of about 52 g/m$^2$) with a deposition of 6.0 g/m$^2$ when dried, so that a first thermosensitive color-forming layer was formed on the high quality paper.

The decolorizing layer formation liquid was then coated on the first thermosensitive coloring layer with a deposition of 3.0 g/m$^2$ when dried, so that a decolorizing layer was formed on the high temperature color-forming layer.

Finally, the second thermosensitive coloring layer formation liquid was coated on the decolorizing layer with a deposition of 3.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 1 according to the present invention was prepared.

EXAMPLE 1-2

Example 1-1 was repeated except that N,N'-isophthaloylbiscaprolactam employed in Dispersion C-1 in Example 1-1 was replaced by N,N'-isophthaloylbispiperazine, whereby a two-color thermosensitive recording material No. 1-2. according to the present invention was prepared.

COMPARATIVE EXAMPLE 1-1

Example 1-1 was repeated except that N,N'-isophthaloylbiscaprolactam employed in Dispersion C-1 in Example 1-1 was replaced by distearylamine, whereby a comparative two-color thermosensitive recording material No. 1-1 was prepared.

EXAMPLE 1-3

Example 1-1 was repeated except that the second thermosensitive coloring layer formation liquid employed in Example 1-3 was replaced by the following second thermosensitive coloring layer formation liquid which was prepared as follows:

Dispersions D and F were prepared by dispersing the components of each dispersion in a sand mill until the average particle size of each solid component became 2 to 3 μm.

| Dispersion D | Parts by Weight |
|---|---|
| 3-(N—ethyl-N—amylamino)-6-methyl-7-anilinofluoran (Black) | 20 |
| 10% aqueous solution of hydroxyethylcellulose | 20 |
| Water | 60 |

| Dispersion F | Parts by Weight |
|---|---|
| Benzyl p-hydroxybenzoate | 18 |
| Calcium carbonate | 12 |
| 10% aqueous solution of polyvinyl alcohol | 30 |
| Water | 40 |

10 parts by weight of the above prepared Dispersion D, 35 parts by weight of Dispersion F and 55 parts by weight of water were mixed well, so that a second thermosensitive coloring layer formation liquid was prepared.

A first thermosensitive coloring layer formation liquid which was the same as that employed in Example 1-1 was first coated on a sheet of commercially available high quality paper (with a basis weight of about 52 g/m$^2$) with a deposition of 6.0 g/m$^2$ when dried, so that a first thermosensitive coloring layer was formed on the high quality paper.

A decolorizing layer formation liquid (Dispersion C-1) which was the same as that employed in Example 1-1 was then coated on the first thermosensitive coloring layer with a deposition of 3.0 g/m$^2$ when dried, so that a decolorizing layer was formed on the high temperature color-forming layer.

Finally, the above prepared second thermosensitive coloring layer formation liquid was coated on the decolorizing layer with a deposition of 2.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 1-3 according to the present invention was prepared.

COMPARATIVE EXAMPLE 1-2

Example 1-3 was repeated except that N,N'-isophthaloylbiscaprolactam employed in Dispersion C-1 in Example 1-3 was replaced by distearylamine, whereby a comparative two-color thermosensitive recording material No. 1-2 was prepared.

EXAMPLE 1-4

Example 1-1 was repeated except that the decolorizing layer employed in Example 1-1 was eliminated and the first thermosensitive coloring layer formation liquid was replaced by the following first thermosensitive coloring layer formation liquid which was prepared as follows:

Dispersions G and C were prepared by dispersing the components of each dispersion in a sand mill until the average particle size of each solid component became 2 to 3 μm.

| Dispersion G | Parts by Weight |
|---|---|
| 3,6-diacethyloxy-4',5',6',7'-tetrachlorofluoresceine | 20 |
| 10% aqueous solution of hydroxyethylcellulose | 20 |
| Water | 60 |

| Dispersion C-1 | Parts by Weight |
|---|---|
| N,N'—isophthaloylbiscaprolactam | 20 |

-continued

| Dispersion C-1 | Parts by Weight |
|---|---|
| 10% aqueous solution of polyvinyl alcohol | 20 |
| Water | 60 |

10 parts by weight of the above prepared Dispersion G, 50 parts by weight of Dispersion C-1 and 40 parts by weight of water were mixed well, so that a first thermosensitive coloring layer formation liquid was prepared.

The above prepared first thermosensitive color-forming layer formation liquid was first coated on a sheet of commercially available high quality paper (with a basis weight of about 52 g/m$^2$) with a deposition of 4.0 g/m$^2$ when dried, so that a first thermosensitive coloring layer was formed on the high quality paper.

A second thermosensitive coloring layer formation liquid which was the same as that employed in Example 1-1 was coated on the above first thermosensitive coloring layer with a deposition of 3.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 1-4 according to the present invention was prepared.

EXAMPLE 1-5

Example 1-1 was repeated except that the first thermosensitive coloring layer formation liquid employed in Example 1-1 was replaced by the following first thermosensitive coloring layer formation liquid which was prepared as follows:

Dispersions H and I were prepared by dispersing the following components of each dispersion in a sand mill until the average particle size of each solid component became 2 to 3 μm.

| Dispersion H | Parts by Weight |
|---|---|
| Iron stearate | 20 |
| 10% aqueous solution of polyvinyl alcohol | 20 |
| Water | 60 |

| Dispersion I | Parts by Weight |
|---|---|
| 1-formyl-4-phenylsemicarbazide | 20 |
| 10% aqueous solution of polyvinyl alcohol | 20 |
| Water | 60 |

40 parts by weight of the above prepared Dispersion H, 40 parts by weight of Dispersion I and 20 parts by weight of water were mixed well, so that a first thermosensitive coloring layer formation liquid was prepared.

The above prepared first thermosensitive coloring layer formation liquid was first coated on a sheet of commercially available high quality paper (with a basis weight of about 52 g/m$^2$) with a deposition of 5.0 g/m$^2$ when dried, so that a first thermosensitive coloring layer was formed on the high quality paper.

A decolorizing layer formation liquid which was the same as that employed in Example 1-1 was then coated on the first thermosensitive coloring layer with a deposition of 3.0 g/m$^2$ when dried, so that a decolorizing layer was formed on the first thermosensitive coloring layer.

Finally, a second thermosensitive color-forming layer formation liquid which was the same as that employed in Example 1-1 was coated on the decolorizing layer with a deposition of 3.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 1-5 according to the present invention was prepared.

The two-color thermosensitive recording materials No. 1-1 through No. 1-5 according to the present invention and the comparative two-color thermosensitive recording materials No. 1-1 and No. 1-2 were subjected to a thermal printing test by use of a G-III facsimile test apparatus including a thermal head (made by Matsushita Electronic Components Co., Ltd.) having 8 dots per mm, with a heat emitting resistance being about 400 ohm/dot, under the conditions that the power applied to the head for coloring the second thermosensitive coloring layer was 1.0 mJ/dot, the power applied to the head for coloring the first thermosensitive coloring layer was 3.0 mJ/dot, the main scanning speed was 20 msec/line, the subscanning recording speed was 3.85 l/mm, and the pressure application by the platen was 1.5 kg/cm$^2$. The results were as follows:

TABLE 1

| Thermosensitive Recording Material | Developed Image Density | |
|---|---|---|
| | Low Temperature Coloring (2nd Layer) | High Temperature Coloring (1st Layer) |
| Example No. 1-1 | 1.10 | 1.01 |
| Example No. 1-2 | 1.12 | 1.00 |
| Example No. 1-3 | 1.23 | 0.98 |
| Example No. 1-4 | 1.07 | 0.90 |
| Example No. 1-5 | 1.09 | 0.95 |
| Comparative Example No. 1-1 | 1.11 | 0.85 |
| Comparative Example No. 1-2 | 1.10 | 0.86 |

In Examples No. 1-1 to No. 1-5, the color developed in the second thermosensitive coloring layer by low temperature heat application was black, while the color developed in the first thermosensitive coloring layer by high temperature heat application was red, and the color separation was excellent. In sharp contrast to this, in Comparative Examples No. 1-1 and 1-2, color separation was extremely poor.

These results indicate that in the present invention, excellent color separation and high image density can be obtained even if the first thermosensitive coloring layer is a conventional high temperature color-forming layer.

EXAMPLE 2-1

(1) Preparation of First Thermosensitive Coloring Layer Formation Liquid

Dispersions A and B were prepared by dispersing the following components of each dispersion in a sand mill until the average particle size of each solid component became 2 to 3 μm.

| Dispersion A | Parts by Weight |
|---|---|
| 3-diethylamino-7-chlorofluoran (Red) | 20 |

-continued

| Dispersion A | Parts by Weight |
|---|---|
| 10% aqueous solution of hydroxy-ethylcellulose | 20 |
| Water | 60 |

| Dispersion B | Parts by Weight |
|---|---|
| Bisphenol A | 12 |
| Ethylenebisstearamide | 6 |
| Calcium carbonate | 9 |
| 10% aqueous solution of polyvinyl alcohol | 30 |
| Water | 43 |

10 parts by weight of the above prepared Dispersion A, 60 parts by weight of Dispersion B and 30 parts by weight of water were mixed well, so that a first thermosensitive coloring layer formation liquid was prepared.

(2) Preparation of Decolorizing Layer Formation Liquid

Dispersion C-2 was prepared by dispersing the following components in a sand mill until the average particle size of each solid component became 2 to 3 μm:

| Dispersion C-2 | Parts by Weight |
|---|---|
| N,N'—bis(benzoylaminopropyl)piperazine | 20 |
| 10% aqueous solution of polyvinyl alcohol | 20 |
| Water | 60 |

(3) Preparation of Second Thermosensitive Coloring Layer Formation Liquid

Dispersions D and E were prepared by dispersing the following components of each dispersion in a sand mill until the average particle size of each solid component became 2 to 3 μm.

| Dispersion D | Parts by Weight |
|---|---|
| 3-(N—ethyl-N—amylamino)-6-methyl-7-anilinofluoran (Black) | 20 |
| 10% aqueous solution of hydroxy-ethylcellulose | 20 |
| Water | 60 |

| Dispersion E | Parts by Weight |
|---|---|
| 3,3'-dichlorophenylthiourea | 12 |
| Stearamide | 6 |
| Calcium carbonate | 12 |
| 10% aqueous solution of polyvinyl alcohol | 30 |
| Water | 40 |

10 parts by weight of the above prepared Dispersion D, 60 parts by weight of Dispersion E and 30 parts by weight of water were mixed well, so that a second thermosensitive coloring layer formation liquid was prepared.

The first thermosensitive coloring layer formation liquid was first coated on a sheet of commercially available high quality paper (with a basis weight of about 52 g/m$^2$) with a deposition of 6.0 g/m$^2$ when dried, so that a first thermosensitive coloring layer was formed on the high quality paper.

The decolorizing layer formation liquid was then coated on the high temperature color-forming layer with a deposition of 3.0 g/m$^2$ when dried, so that a decolorizing layer was formed on the first thermosensitive coloring layer.

Finally, the second thermosensitive coloring layer formation liquid was coated on the decolorizing layer with a deposition of 3.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 2-1 according to the present invention was prepared.

EXAMPLE 2-2

Example 2-1 was repeated except that N,N'-bis(benzoylaminopropyl)piperazine employed in Dispersion C-2 in Example 2-1 was replaced by N,N'-bis(benzoylaminohexyl)piperazine, whereby a two-color thermosensitive recording material No. 2-2 according to the present invention was prepared.

EXAMPLE 2-3

Example 2-1 was repeated except that N,N'-bis(benzoylaminopropyl)piperazine employed in Dispersion C-2 in Example 2-1 was replaced by N,N'-bis(p-methoxycarbonylbenzoylaminopropyl)piperazine, whereby a two-color thermosensitive recording material No. 2-3 according to the present invention was prepared.

COMPARATIVE EXAMPLE 2-1

Example 2-1 was repeated except that N,N'-bis(benzoylaminopropyl)piperazine employed in Dispersion C-2 in Example 2-1 was replaced by tribenzylamine, whereby a comparative two-color thermosensitive recording material No. 2-1 was prepared.

EXAMPLE 2-4

Example 2-1 was repeated except that the decolorizing layer was eliminated and the first thermosensitive coloring layer formation liquid was replaced by the following first thermosensitive coloring layer formation liquid which was prepared as follows:

Dispersions G and C-2 were prepared by dispersing the following components of each dispersion in a sand mill until the average particle size of each solid component became 2 to 3 μm.

| Dispersion G | Parts by Weight |
|---|---|
| 3,6-diacethyloxy-4',5',6',7'-tetra-chlorofluoresceine | 20 |
| 10% aqueous solution of hydroxy-ethylcellulose | 20 |
| Water | 60 |

| Dispersion C-2 | Parts by Weight |
|---|---|
| N,N'—bis(benzoylaminopropyl)piperazine | 20 |
| 10% aqueous solution of polyvinyl alcohol | 20 |
| Water | 60 |

10 parts by weight of the above prepared Dispersion G, 50 parts by weight of Dispersion C-2 and 40 parts by weight of water were mixed well, so that a first thermosensitive coloring layer formation liquid was prepared.

The above prepared first thermosensitive coloring layer formation liquid was first coated on a sheet of commercially available high quality paper (with a basis weight of about 52 g/m$^2$) with a deposition of 4.0 g/m$^2$ when dried, so that a first thermosensitive coloring layer was formed on the high quality paper.

A second thermosensitive coloring layer formation liquid which was the same as that employed in Example 2-1 was coated on the above first thermosensitive coloring layer with a deposition of 3.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 2-4 according to the present invention was prepared.

EXAMPLE 1-5

Example 2-1 was repeated except that the first thermosensitive coloring layer formation liquid employed in Example 2-1 was replaced by the following first thermosensitive coloring layer formation liquid which was prepared as follows:

Dispersions H and I were prepared by dispersing the following components of each dispersion in a sand mill until the average particle size of each solid component became 2 to 3 μm.

| Dispersion H | Parts by Weight |
|---|---|
| Iron stearate | 20 |
| 10% aqueous solution of polyvinyl alcohol | 20 |
| Water | 60 |

| Dispersion I | Parts by Weight |
|---|---|
| 1-formyl-4-phenylsemicarbazide | 20 |
| 10% aqueous solution of polyvinyl alcohol | 20 |
| Water | 60 |

40 parts by weight of the above prepared Dispersion H, 40 parts by weight of Dispersion I and 20 parts by weight of water were mixed well, so that a first thermosensitive coloring layer formation liquid was prepared.

The first thermosensitive coloring layer formation liquid was first coated on a sheet of commercially available high quality paper (with a basis weight of about 52 g/m$^2$) with a deposition of 6.0 g/m$^2$ when dried, so that a first thermosensitive coloring layer was formed on the high quality paper.

A decolorizing layer formation liquid which was the same as that employed in Example 2-1 was then coated on the first thermosensitive coloring layer with a deposition of 3.0 g/m$^2$ when dried, so that a decolorizing layer was formed on the first thermosensitive coloring layer.

Finally, a second thermosensitive coloring layer formation liquid which was the same as that employed in Example 2-1 was coated on the decolorizing layer with a deposition of 3.5 g/m$^2$ when dried, so that a two-color thermosensitive recording material was prepared. This two-color thermosensitive recording material was subjected to calendering so as to have a smoothness of 500 sec to 1500 sec, whereby a two-color thermosensitive recording material No. 2-5 according to the present invention was prepared.

The two-color thermosensitive recording materials No. 2-1 through No. 2-5 according to the present invention and the comparative two-color thermosensitive recording material No. 2-1 were subjected to a thermal printing test by use of a G-III facsimile test apparatus including a thermal head (made by Matsushita Electronic Components Co., Ltd.) having 8 dots per mm, with a heat emitting resistance being about 400 ohm/dot, under the conditions that the power applied to the head for coloring the second thermosensitive coloring layer was 1.0 mJ/dot, the power applied to the head for coloring the first thermosensitive coloring layer was 3.0 mJ/dot, the main scanning speed was 20 msec/line, the subscanning recording speed was 3.85 l/mm, and the pressure application by the platen was 3.0 kg/A-4 size width. The results were as follows:

TABLE 2

| | Ex. 1 | Ex. 2 | Ex. 3 | Comp. Ex. | Ex. 4 | Ex. 5 |
|---|---|---|---|---|---|---|
| Low Temp. Color (Black) | 1.12 | 1.11 | 1.12 | 1.11 | 1.07 | 1.09 |
| High Temp. Color (Red) | 1.00 | 0.98 | 1.01 | 0.85 | 0.90 | 0.95 |
| Color Separation | o | o | o | x | o | o |
| I.D. of Black after 1 Month | 1.08 | 1.09 | 1.09 | 0.53 | 1.06 | 1.07 |
| B.D. after 1 Month | 0.08 | 0.08 | 0.08 | 0.18* | 0.09 | 0.10 |

In the above Table 2, Low Temp. Color(Black) denotes a black color developed in the second thermosensitive coloring layer; High Temp. Color (Red), a red color developed in the first thermosensitive coloring layer; I.D. of Black after 1 Month, the image density of the black color after it was allowed to stand at room temperature for one month; and B.D. after 1 Month, one-month-later background density after the above image formation. * denotes that the background turned yellowish; o denotes excellent color separation, and x denotes that color mixing was conspicuous.

In Examples No. 2-1 to No. 2-5, the color developed in the second thermosensitive coloring layer by the low temperature coloring was black, while the color developed in the first thermosensitive coloring layer by the high temperature coloring was red, and the color separation was excellent. In sharp contrast to this, in Comparative Examples No. 2-1, color mixing was conspicuous.

These results indicate that in the present invention, excellent color separation and stable high image density can be obtained even if the first thermosensitive coloring layer is a conventional high temperature color-forming layer.

What is claimed is:

1. A two-color thermosensitive recording material comprising a support material, a first thermosensitive coloring layer and a second thermosensitive coloring layer supported on said support material, with said second thermosensitive coloring layer overlaid on said first thermosensitive coloring layer, the colors developed by said two coloring layers being different from each other, the coloring temperature for said second thermosensitive coloring layer being lower than that for said first thermosensitive coloring layer, at least said second thermosensitive coloring layer containing a basic leuco dye and a color developer capable of inducing color formation in said leuco dye upon application of thermal energy, and a decolorizing agent for decoloring the color developed in said second thermosensitive coloring layer at the time of color development of said first thermosensitive coloring layer being contained in said first thermosensitive coloring layer or in a decolorizing intermediate layer interposed between said first thermosensitive coloring layer and said second thermosensitive layers, which decolorizing agent is selected from the group consisting of:

(i) a di-substituted aromatic diamide derivative having the formula (I),

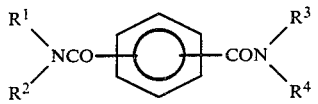

(I)

wherein $R^1$, $R^2$, $R^3$ and $R^4$ independently represent hydrogen, an alkyl group, a cycloalkyl group, an aryl group or an aralkyl group, and $R^1$ and $R^2$, and/or $R^3$ and $R^4$ can respectively form rings by the terminals of the respective groups being combined with each other, and (ii) a piperazine derivative including two acylamino groups, having the formula (II),

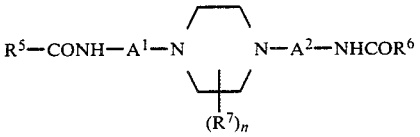

(II)

wherein $A^1$ and $A^2$ represent an alkylene group, $R^5$ and $R^6$ independently represent hydrogen, a non-substituted or substituted alkyl group, a non-substituted or substituted aryl group, a non-substituted or substituted aralkyl group, a non-substituted or substituted cycloalkyl group, $R^7$ represents a lower alkyl group, and n is an integer of 0 to 2.

2. A two-color thermosensitive recording material as claimed in claim 1, wherein said first thermosensitive coloring contains an acidic leuco dye and at least one of said di-substrated aromatic diamide derivative and said piperazine derivative.

3. A two-color thermosensitive recording material as claimed in claim 1, wherein said decolorizing agent is contained in said decolorizing intermediate layer and said first thermosensitive coloring contains a basic leuco dye and a color developer capable of inducing color formation in said basic leuco dye upon application of heat at a predetermined temperature.

4. A two-color thermosensitive recording material as claimed in claim 2, wherein said acidic leuco dye is selected from the group consisting of:

3,3-bis(p-acetyloxyphenyl)phthalide,
3,3-bis(3,5-dibromo-4-acetyloxyphenyl)phthalide,
3,3-bis(3-methyl-4-acetyloxyphenyl)phthalide,
3,3-bis(3-isopropyl-4-acetyloxyphenyl)phthalide,
3,3-bis(p-acetyloxyphenyl)-4',5',6',7'-tetrachlorophthalide,
3,6-diacetyloxyfluoresceine,
3,6-diacetyloxy-2,4,5,7-tetrabromofluoresceine,
3,6-diacetyloxy-4',5',6',7'-tetrachlorofluoresceine, and
3,6-diacetyloxy-2,4,5,7-tetrabromo-4',5',6',7'-tetrachlorofluoresceine.

5. A two-color thermosensitive recording material as claimed in claim 3, wherein said basic leuco dye is selected from the group consisting of:

3-diethylamino-7-chlorofluoran,
3-diethylamino-6-methyl-7-chlorofluoran,
3-cychohexylamino-6-chlorofluoran, and
3-diethylaminobezo[α]fluoran.

6. A two-color thermosensitive recording material as claimed in claim 1, wherein said di-substituted aromatic diamide derivative is selected from the group consisting of:

N,N'-terephthaloylbispiperizine,
N,N'-isophthaloylbispiperizine,
N,N'-phthaloylbispiperizine,
N,N'-terephthaloylbismorpholine,
N,N'-isophthaloylbismorpholine,
N,N'-phthaloylbismorpholine,
N,N'-terephthaloylbis-4-methylpiperazine,
N,N'-isophthaloylbis-4-methylpiperazine,
N,N'-phthaloylbis-4-methylpiperazine,
N,N'-terephthaloylbis-4-phenylpiperazine,
N,N'-isophthaloylbis-4-phenylpiperazine,
N,N'-phthaloylbis-4-phenylpiperazine,
N,N'-terephthaloylbis-4-propylpiperazine,
N,N'-isophthaloylbis-4-propylpiperazine,
N,N'-phthaloylbis-4-propylpiperazine,
N,N'-terephthaloylbiscaprolactam,
N,N'-isophthaloylbiscaprolactam,
N,N'-phthaloylbiscaprolactam,
N,N'-terephthaloylbis-3-chlorocaprolactam,
N,N'-isophthaloylbis-3-chlorocaprolactam,
N,N'-phthaloylbis-3-chlorocaprolactam,
N,N'-terephthaloylbisvalerolactam,
N,N'-isophthaloylbisvalerolactam,
N,N'-phthaloylbisvalerolactam,
N,N'-terephthaloylbispyrrolidine,
N,N'-isophthaloylbispyrrolidine,
N,N'-phthaloylbispyrrolidine,
N,N'-terephthaloylbis-diethylamine,
N,N'-isophthaloylbis-diethylamine,
N,N'-phthaloylbis-diethylamine,
N,N'-terephthaloylbis-dipropylamine,
N,N'-isophthaloylbis-dipropylamine,
N,N'-terephthaloylbis-dibutylamine,
N,N'-isophthaloylbis-dibutylamine,
N,N'-terephthaloylbis-cyclohexyl-methylamine,
N,N'-isophthaloylbis-cyclohexyl-methylamine,
N,N'-terephthaloylbis-dicyclohexylamine,
N,N'-isophthaloylbis-dicyclohexyamine,
N,N'-terephthaloylbis-dibenzylamine,
N,N'-isophthaloylbis-dibenzylamine,
N,N'-terephthaloylbis-dioctylamine,
N,N'-isophthaloylbis-dioctylamine,
N,N'-terephthaloylbis-diethoxypropylamine,
N,N'-terephthaloylbis-4-chlorobutylamine,
N,N'-terephthaloylbis-dibenzoylaminoethylamine,
N,N'-isophthaloylbis-dibenzoylaminoethylamine,
N,N'-terephthaloylbis-benzoylaminopropylamine,
N,N'-isophthaloylbis-benzoylaminopropylamine,
N,N'-terephthaloylbis-diacetylaminoethylamine, and
N,N'-isophthaloylbis-diacetylaminoethylamine.

7. A two-color thermosensitive recording material as claimed in claim 1, wherein said piperazine derivative is selected from the group consisting of:

N,N'-bis(benzoylaminopropyl)piperazine,

N,N'-bis(benzoylaminoethyl)piperazine,
N,N'-bis(benzoylaminobutyl)piperazine,
N,N'-bis(benzoylaminopentyl)piperazine,
N,N'-bis(benzoylaminohexyl)piperazine,
N,N'-bis(benzoylaminooctyl)piperazine,
N,N'-bis(benzoylaminolauryl)piperazine,
N,N'-bis(benzoylaminostearyl)piperazine,
N,N'-bis(p-chlorobenzoylaminopropyl)piperazine,
N,N'-bis(p-isopropylbenzylaminopropyl)piperazine,
N,N'-bis(p-methylbenzoylaminopropyl)piperazine,
N,N'-bis(m-methylbenzoylaminopropyl)piperazine,
N,N'-bis(o-chlorobenzoylaminopropyl)piperazine,
N,N'-bis(p-chlorobenzoylaminoethyl)piperazine,
N,N'-bis(p-chlorobenzoylaminohexyl)piperazine,
N,N'-bis(p-methylbenzoylaminohexyl)piperazine,
N,N'-bis(o-chlorobenzoylaminohexyl)piperazine,
N,N'-bis(benzoylaminopropyl)piperazine,
N,N'-bis(cyclohexylaminopropyl)piperazine,
N,N'-bis(cyclohexylbutylylaminopentyl)piperazine,
N,N'-bis(pivaloylaminopropyl)piperazine,
N,N'-bis(stearoylaminopropyl)piperazine,
N,N'-bis(phenylacetylaminopropyl)piperazine,
N,N'-bis(phenethyloylaminostearyl)piperazine,
N,N'-bis(α-naphthoylaminoethyl)piperazine,
N,N'-bis(β-naphthoylaminoethyl)piperazine,
N,N'-bis(α-naphthoylaminopropyl)piperazine,
N,N'-bis(β-naphthoylaminopropyl)piperazine,
N,N'-bis(p-methoxycarbonylbenzoylaminopropyl) piperazine, and
N,N'-bis(p-methoxybenzoylaminopropyl)piperazine.

* * * * *